US010295321B2

(12) United States Patent
Braden et al.

(10) Patent No.: US 10,295,321 B2
(45) Date of Patent: May 21, 2019

(54) PROJECTILE TRACKING DEVICE

(71) Applicants: Yvonne Louise Braden, Villa Grove, CO (US); Gerald Floyd Braden, Villa Grove, CO (US)

(72) Inventors: Yvonne Louise Braden, Villa Grove, CO (US); Gerald Floyd Braden, Villa Grove, CO (US)

( * ) Notice: Subject to any disclaimer, the term of this patent is extended or adjusted under 35 U.S.C. 154(b) by 0 days.

(21) Appl. No.: 15/922,494

(22) Filed: Mar. 15, 2018

(65) Prior Publication Data

US 2018/0202784 A1 Jul. 19, 2018

Related U.S. Application Data

(63) Continuation-in-part of application No. 15/691,390, filed on Aug. 30, 2017.

(60) Provisional application No. 62/423,632, filed on Nov. 17, 2016.

(51) Int. Cl.

| | |
|---|---|
| ***F42B 6/04*** | (2006.01) |
| ***F42B 12/38*** | (2006.01) |
| ***F42B 6/08*** | (2006.01) |

(52) U.S. Cl.

CPC ..... *F42B 12/385* (2013.01); *F42B 6/04* (2013.01); *F42B 6/08* (2013.01)

(58) Field of Classification Search

CPC ..... F42B 6/04; F42B 6/06; F42B 6/08; F42B 12/385

See application file for complete search history.

(56) References Cited

U.S. PATENT DOCUMENTS 2,725,656 A * 12/1955 Schmidt ..... F42B 6/08 43/6
2,859,970 A * 11/1958 Doonan ..... F42B 6/08 43/6

(Continued)

FOREIGN PATENT DOCUMENTS

WO 2016140667 9/2016

OTHER PUBLICATIONS

"Raven In-Arrow Tracking System", available on the Internet at least as early as Aug. 17, 2018, Copyright 2018, 4 pages, Raven In-Arrow Tracking.

(Continued)

*Primary Examiner* — John A Ricci
(74) *Attorney, Agent, or Firm* — Trenner Law Firm, LLC; Mark D. Trenner

(57) ABSTRACT

A projectile tracking with stop device is disclosed. An example projectile tracking with stop device includes an outer sleeve and an inner shaft, the outer sleeve having an interior chamber assembled over an exterior portion of the inner shaft, the outer sleeve and the inner shaft assembled for connecting to a projectile. The example projectile tracking with stop device also includes at least one stop-blade attached on a pin in the inner shaft. The at least one stop-blade folds into the inner shaft when the outer sleeve is in a closed position. The at least one stop-blade expands out beyond an outer circumference of the outer sleeve when the outer sleeve moves to an open position. In an example, the projectile tracking with stop device also includes a microchip positioned at least partly in a chamber of the inner shaft. The microchip emits a tracking signal for locating the projectile.

22 Claims, 9 Drawing Sheets

(56) References Cited

U.S. PATENT DOCUMENTS

| | | | | |
|---|---|---|---|---|
| 2,939,708 | A * | 6/1960 | Scheib | F42B 6/08 43/6 |
| 3,014,305 | A * | 12/1961 | Yurchich | F42B 6/08 43/6 |
| 7,300,367 | B1 | 11/2007 | Andol et al. | |
| 7,632,199 | B2 | 12/2009 | Kikos | |
| 7,713,152 | B1 | 5/2010 | Tentler et al. | |
| 8,043,177 | B2 | 10/2011 | Flanagan | |
| 8,075,430 | B1 | 12/2011 | Hester | |
| 8,133,138 | B1 | 3/2012 | Hannah | |
| 9,075,124 | B2 | 7/2015 | Zusman et al. | |
| 9,423,504 | B1 | 8/2016 | Gossett et al. | |
| 9,829,294 | B1 | 11/2017 | Patel | |
| 2005/0231362 | A1 | 10/2005 | Pridmore, Jr. et al. | |
| 2007/0105668 | A1 | 5/2007 | Kikos | |
| 2012/0196708 | A1 | 8/2012 | Maddox | |
| 2016/0146584 | A1 | 5/2016 | Shepherd et al. | |
| 2017/0241756 | A1 | 8/2017 | White, Jr. et al. | |
| 2018/0135951 | A1 | 5/2018 | Lish | |
| 2018/0135952 | A1 | 5/2018 | Braden | |

OTHER PUBLICATIONS

"Protracker—The Ultimate Tracking and Recovery System", available on the Internet at least as early as Aug. 17, 2018, Copyright 2017-2018, 14 pages, Pro-Tracker LLC.

"Breadcrumb Trackable Technology", available on the Internet at least as early as Aug. 17, 2018 Copyright 2018, 4 pages, Breadcrumb LLC.

Breadcrumb Trackable Technology, "Bluetooth Nock-Arrow", available on the Internet at least as early as Aug. 17, 2018, Copyright 2018, 3 pages, Breadcrumb LLC.

"RFID Arrow Tracker", available on the Internet at least as early as Aug. 17, 2018, 1 page.

"Protracker the Ultimate Tracking and Recovery System System Manual", downloaded from the internet on Dec. 6, 2018, 16 pages, Pro-Tracker LLC.

* cited by examiner

PROJECTILE TRACKING DEVICE

CROSS REFERENCE TO RELATED APPLICATIONS

This application is a continuation-in-part (CIP) of U.S. patent application Ser. No. 15/691,390 filed Aug. 30, 2017 of Braden, et al. for "Projectile Tracking Device," which claims the priority benefit of U.S. Provisional Patent Application No. 62/423,632 filed Nov. 17, 2016 of Braden, et al. for "Arrow Chip And Stop," each hereby incorporated by reference in its entirety as though fully set forth herein.

BACKGROUND

Arrows (e.g., used for archery or hunting) can easily be lost. For example, during target practice or hunting, a shot arrow may become lost in tall grass, over a ridge, or elsewhere. During hunting, the arrow may lodge in an animal that is able to run away, thus taking the arrow with it. Or the animal may be injured and bleeding, but still able to run away. If the hunter is unable to locate the animal, the animal may die and go to waste.

DETAILED DESCRIPTION

A projectile tracking with stop device is disclosed. An example projectile tracking with stop device includes an outer sleeve and an inner shaft. The outer sleeve has an interior chamber assembled over an exterior portion of the inner shaft. The outer sleeve and the inner shaft are assembled together and connect to a projectile, such as an arrow, to stop the arrow when it hits a target or other object (e.g., an animal), and/or track the arrow if it becomes lost and/or the animal hit by the arrow moves. The example projectile also includes at least one stop-blade attached on a pin in the inner shaft. The stop-blade may include one or more blade that folds into the inner shaft when the outer sleeve is in a closed position. The blade(s) of the stop-blade expand out beyond an outer circumference of the outer sleeve when the outer sleeve moves to an open position (e.g., upon hitting the target). As such, the projectile tracking with stop device may remain in the animal after shooting and does not fall out if the animal continues to move after being shot.

In an example, the projectile tracking with stop device also includes a microchip positioned at least partly in a chamber of the inner shaft. The microchip emits a tracking signal for locating the projectile, such as an arrow, spear, or other projectile. As such, the projectile tracking with stop device enables the user to find the projectile after firing or shooting the projectile (e.g., into an animal such as a deer, elk or turkey; or past a target and thus the arrow becomes lost in the field).

Before continuing, it is noted that as used herein, the terms "includes" and "including" mean, but is not limited to, "includes" or "including" and "includes at least" or "including at least," The term "based on" means "based on" and "based at least in part on."

It should also be noted that the examples shown and described herein are provided for purposes of illustration, and are not intended to be limiting. Other devices and/or device configurations may be utilized to carry out the operations described herein.

Figure 1A:
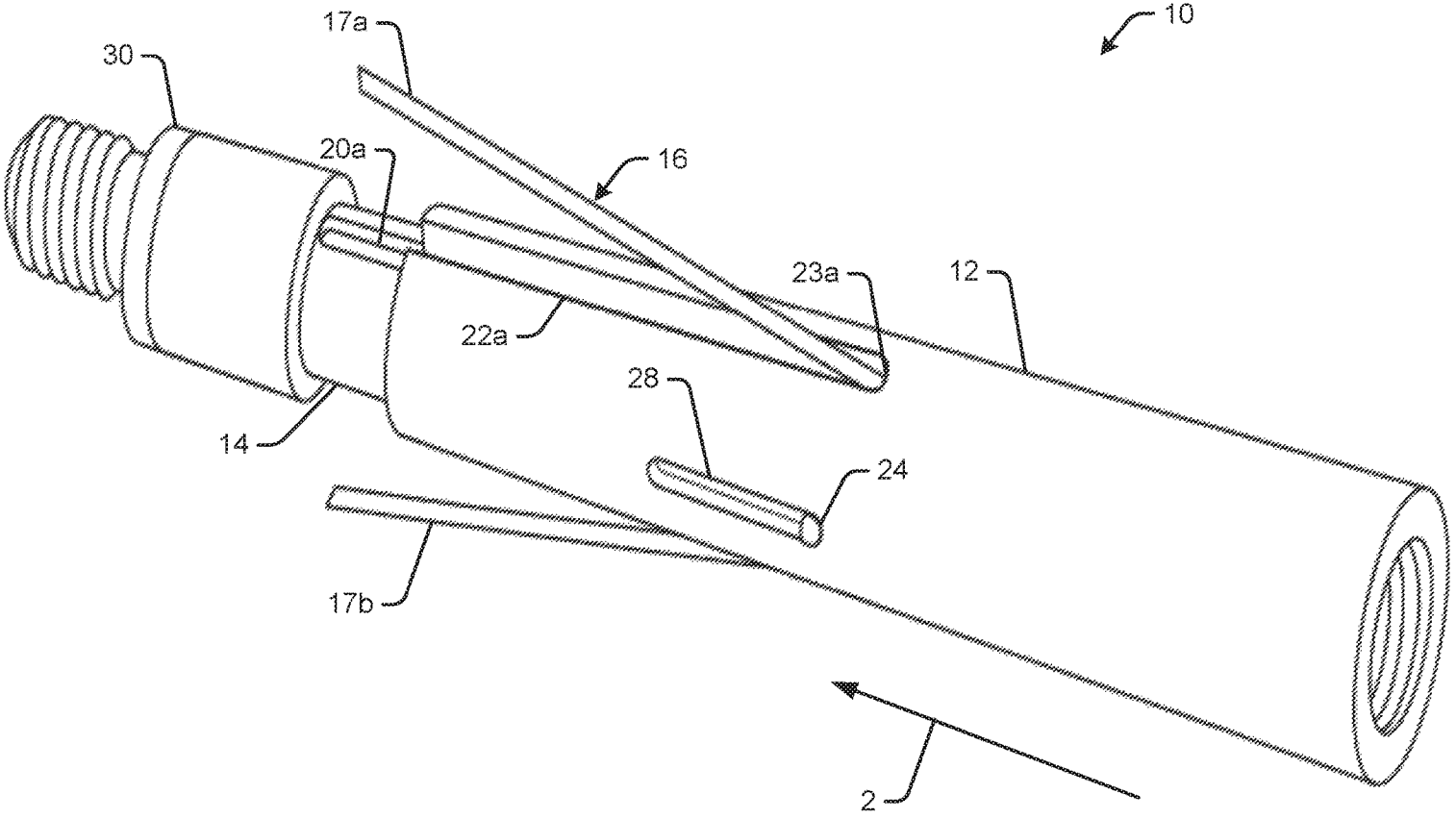
FIG. 1A is a perspective view of an example projectile tracking with stop device shown in an open position.
Figure 1B:
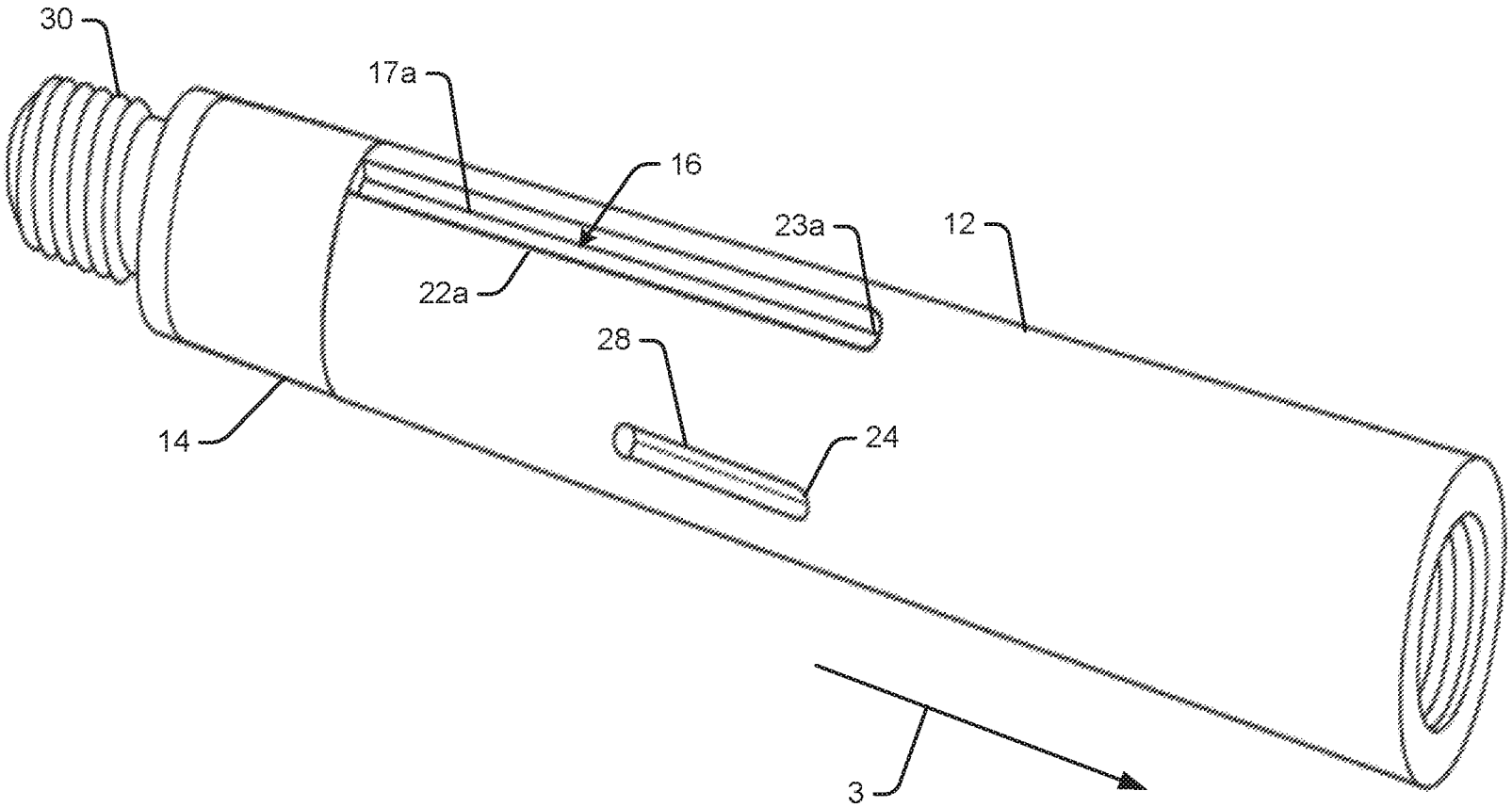
FIG. 1B is a perspective view of the example projectile tracking with stop device in FIG. 1A shown in a closed position.
Figure 2:
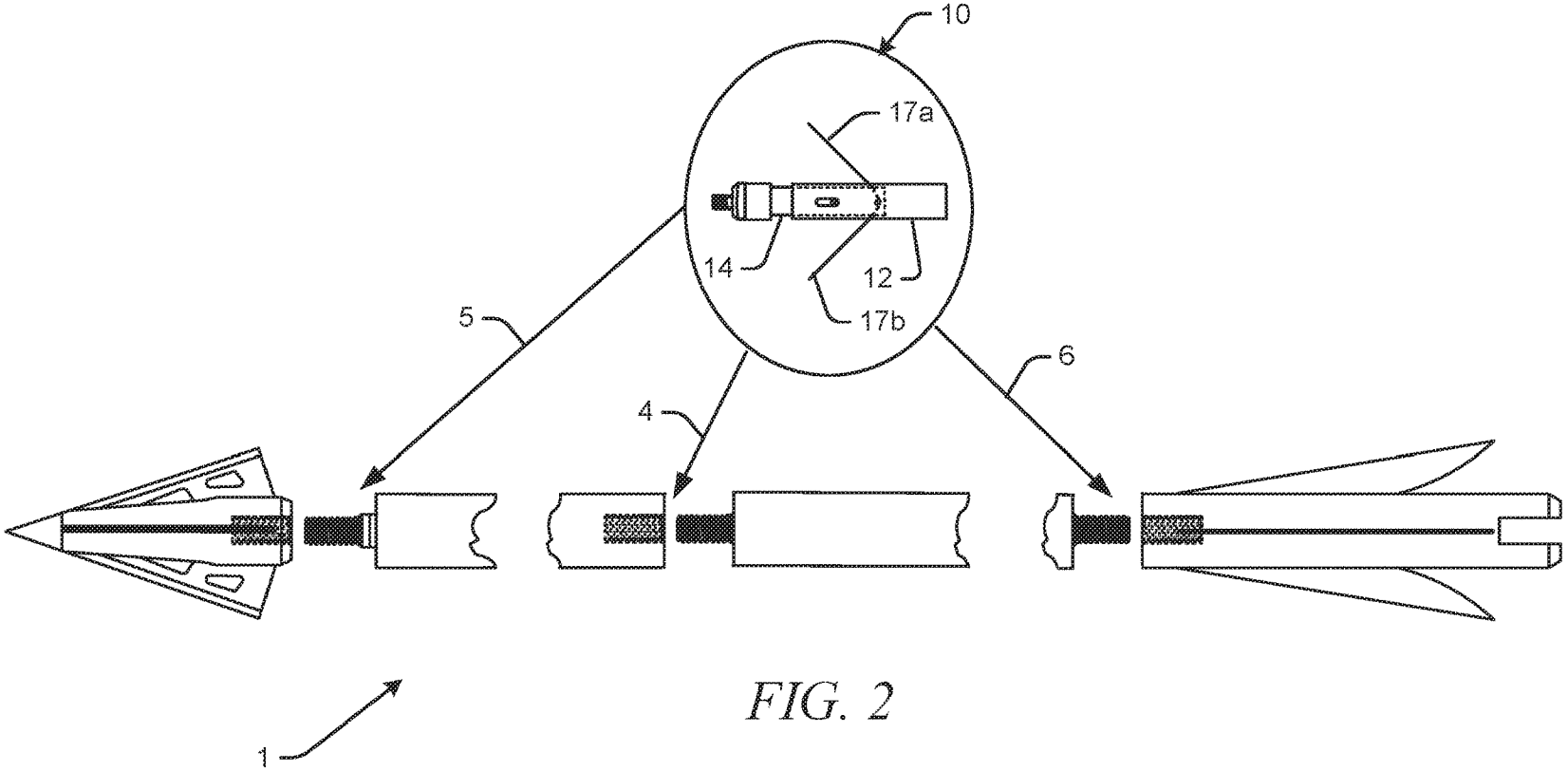
FIG. 2 shows an example projectile tracking with stop device as it may be implemented with an arrow.
Figure 3:
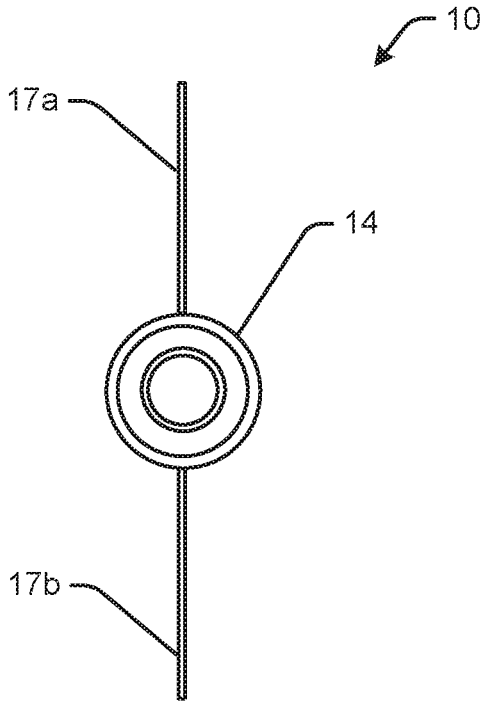
FIG. 3 is an end view of an example projectile tracking with stop device in an open position.
Figure 4:
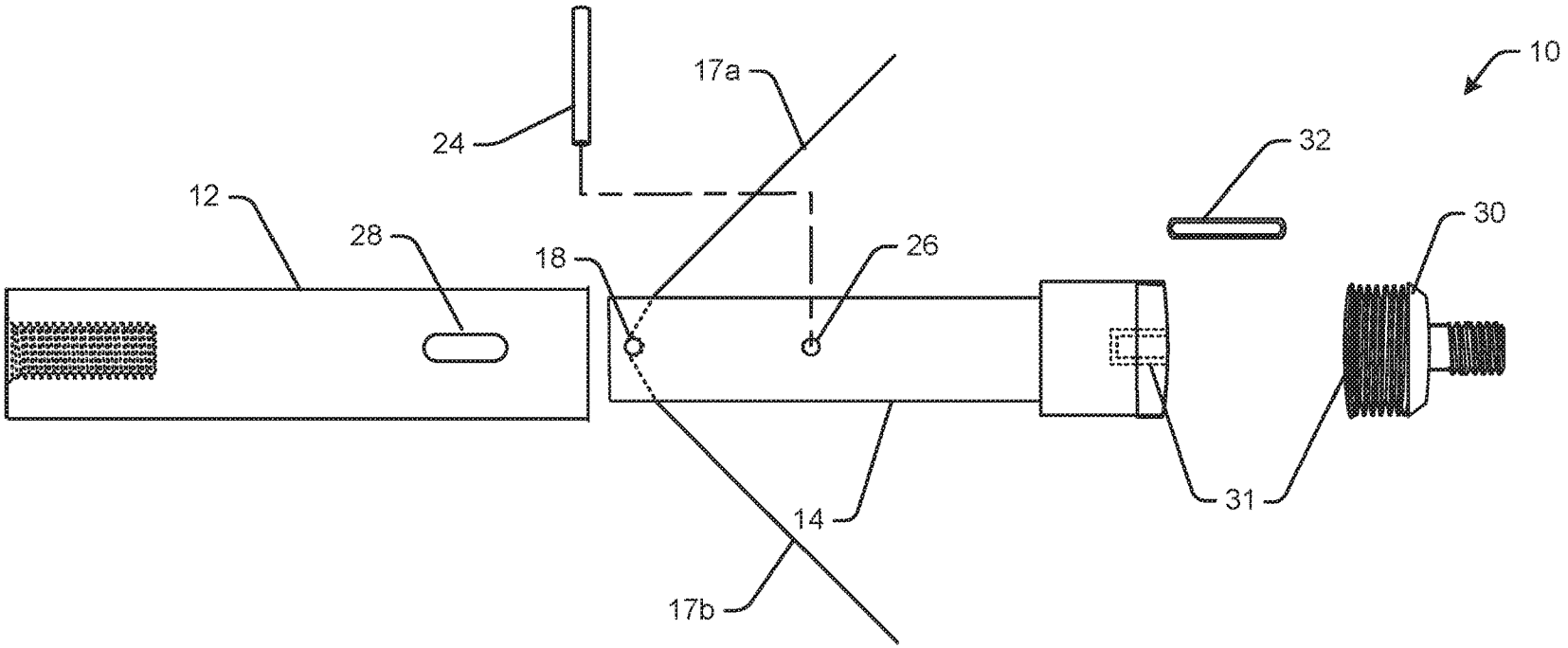
FIG. 4 is an exploded side view of an example projectile tracking with stop device.
Figure 5:
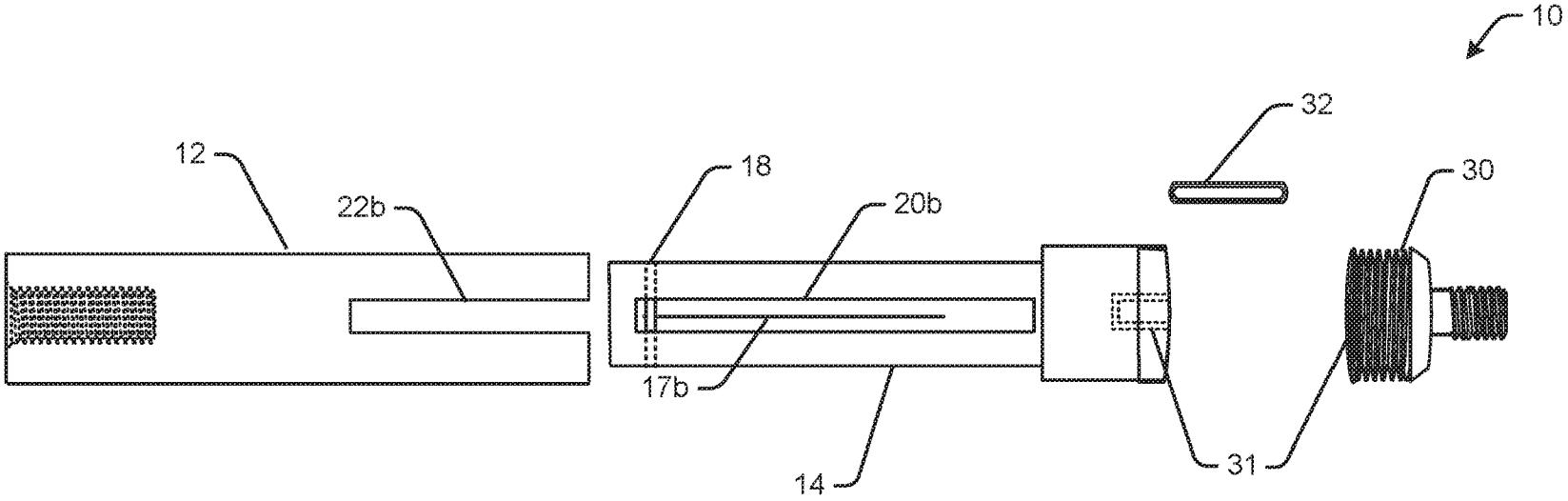
FIG. 5 is an exploded top view of an example projectile tracking with stop device.

FIG. 1A is a perspective view of an example projectile tracking with stop device 10 shown in an open or expanded position. FIG. 1B is a perspective view of the example projectile tracking with stop device 10 of FIG. 1A shown in a closed or collapsed position. FIG. 2 shows the example projectile tracking with stop device 10 as it may be assembled on an arrow. FIG. 3 is an end view of the example projectile tracking with stop device 10 in an open position corresponding to FIG. 1A. FIG. 4 is an exploded side view of the example projectile tracking with stop device 10 in an open position corresponding to FIG. 1A. FIG. 5 is an exploded top view of the example projectile tracking with stop device 10 shown in FIG. 4.

An example projectile tracking device 10 includes an outer sleeve 12 and an inner shaft 14. The outer sleeve 12 has an interior chamber assembled over an exterior portion of the inner shaft 14. In an example, the outer sleeve 12 and the inner shaft 14 are generally cylindrical in shape and slidably fit together. However, other sizes, shapes, and configurations are also contemplated, and are not limited to those shown in the drawings.

The outer sleeve 12 and the inner shaft 14 may be assembled for connecting to a projectile, such as the arrow 1 shown in FIG. 2. However, the device 10 may be implemented with any projectile (e.g., a spear). In an example, the end of inner sleeve 14 is attached on an arrow shaft 1 facing the arrow tip. The other end of the device (the outer sleeve 12) is shown as it may be attached facing toward an arrow tail on the arrow shaft 1. However, the device 10 may be attached in any suitable manner and/or position on the arrow shaft.

At least one stop-blade 16 may be attached on a post or pin 18, in the inner shaft 14 as shown in FIG. 4. The stop-blade 16 folds into the inner shaft 14 when the outer sleeve 14 is in a closed position, as shown in FIG. 1B. The stop-blade 16 expands out beyond an outer circumference of the outer sleeve 12 when the outer sleeve 12 moves to an open position, as shown in FIG. 1B.

In an example, an inner blade slot (only 20*a* is visible in FIGS. 1A and 1B) is formed on each side of the inner shaft 14, and the slots 20*a* and 20*b* extend through the wall of the inner shaft 14, for passage of the stop blade 16 therethrough.

An outer blade slot (only 22*a* is visible in FIGS. 1A and 1B) is formed on each side of the outer sleeve 12, and the slots 22*a* and 22*b* extend through the wall of the outer sleeve 12 for passage of the stop blade 16. The slots 20*a* and 20*b* at least partly align with the slots 22*a* and 22*b* when assembled.

A pin 24 is assembled through an opening (e.g., a pin hole 26) formed through the inner shaft 14 and extending beyond the outer circumference on each side of the inner shaft 14. A slot 28 is formed through the walls of the outer sleeve 12 for travel of the pin 24 in the slot 28. The pin 24 is assembled through the pin hole opening 26 formed through the inner shaft 14. As such, the pin 24 serves as a stop and limits the distance of travel or sliding of the outer sleeve 12 between opposite ends of the slot 28. As such, the pin-in-slot designates travel of the outer sleeve 12 between a first position and a second position. The first position (e.g., FIG. 1A) corresponds to the open position of the outer sleeve 12 on the inner shaft 14, and the second position (e.g., FIG. 1B) corresponds to the closed position of the outer sleeve 12 on the inner shaft 14.

The slot or channel 28 can be moved from one end to the other against the pin 24, enabling and limiting or designating a travel distance of the outer sleeve 12 on the inner shaft 14. This movement is illustrated in the direction of arrows 2 and 3 between a first position (e.g., FIG. 1A) and a second position (e.g., FIG. 1B). In an example, the first position corresponds to the open position of the outer sleeve 14, as shown in FIG. 1A. The second position corresponds to the closed position of the outer sleeve 14, as shown in FIG. 1B).

The stop-blade 16 may have two blades 17*a* and 17*b*. Each of the two blades 17*a* and 17*b* expand out beyond the outer circumference of the outer sleeve 12 (e.g., FIG. 4) when the outer sleeve 12 moves to the open position (FIG. 1A).

The blades 17*a* and 17*b* of the stop-blade 16 are folded in through the outer blade slot 22*a* and 22*b* and the inner blade slot 20*a* and 20*b* of the inner shaft 14 when the outer sleeve 12 moves to the closed position (e.g., in the direction of arrow 2 in FIG. 1A). That is, the corners 23*a* and 23*b* (only 23*a* is visible in FIGS. 1A and 1B) of outer blade slots 22*a* and 22*b* partially cover a portion of the blades 17*a* and 17*b*, respectively, to press the blades 17*a* and 17*b* into the outer blade slots 22*a* and 22*b* and into the inner blade slots 20*a* and 20*b*, and retain the blades 17*a* and 17*b* therein. Upon impact, the outer sleeve 12 travels the distance established by the slot 28 and pin 24, so that the edge 23*a* of slot 22*a* (and edge 23*b* of slot 22*b*) expose the upper shoulder of the blades 17*a* and 17*b*, thus releasing the blades 17*a* and 17*b* under spring action or bias to expand (e.g., as seen in FIG. 1A).

The projectile tracking device 10 may be attached in any suitable manner to the projectile 1. For example, the projectile tracking device 10 may be attached to an arrow shaft in any suitable position, as illustrated by position 4 in FIG. 2. Or for example, the projectile tracking device 10 may be attached to the arrow tip, as shown by position 5 in FIG. 2. Or for example, the projectile tracking device 10 may be attached to the arrow tail, as shown by position 6 in FIG. 2. The projectile tracking device 10 may be attached to an arrow shaft or other projectile, e.g., by threading the ends onto the arrow shaft or other means.

The stop-blade 16 is folded into and maintained in the inner shaft 14 during firing of the projectile 1. As such, the stop-blade 16 may then closed against inner shaft 14, and press the blades 17*a* and 17*b* through the channels 22*a* and 22*b* of the sleeve 12 against the bias of spring, and into the channels 20*a* and 20*b* of the inner shaft 14. It is noted that the process can be reversed for disassembly if need be.

In an example, the stop-blade 16 is spring-hinged (e.g., wrapped around pin 18) or otherwise assembled under a spring force or bias, causing the blades 17*a* and 17*b* to tend in a default position toward the outward position. As such, the blades 17*a* and 17*b* of the stop-blade 16 automatically expand out through the inner blade slot 20*a* and 20*b* and the outer blade slot 22*a* and 22*b* beyond the outer circumference of the outer sleeve 12 when the outer sleeve 12 moves to the open position (e.g., in the direction of arrow 3 in FIG. 1B) and releases the blades 17*a* and 17*b*. As such, the blades 17*a* and 17*b* of the stop-blade 16 automatically expands into the outward or expanded position upon the projectile 1 impacting an object. The expanded blades 17*a* and 17*b* may catch in the object (e.g., the target animal) to prevent the projectile 1 from penetrating through the animal and/or falling out of the animal after the animal has been shot by the arrow 1.

In an example, the blades 17*a* and 17*b* may be angled upon automatically releasing, such that the projectile is not readily released from the animal during movement of the animal. Thus, the blades 17*a* and 17*b* engage with the animal and thus the arrowhead is less likely to fall out of the animal if the animal continues to move.

In an example, a cavity or "end" chamber 31 may be formed in the inner shaft 14, as shown for example in FIGS. 4 and 5. A microchip 32 may be positioned at least partly in the end chamber 31 of the inner shaft 14. For example, the microchip 32 can be positioned in the end chamber 31. The end portion 30 can then be threaded onto the inner shaft 14 to encase the microchip 32 in the housing. The microchip 32 emits a tracking signal for locating the projectile (e.g., the arrow 1 in FIG. 2).

It is noted that other means for attaching the microchip 32 to the projectile 1 are also contemplated. The microchip 32 is not limited to being embedded in a housing. For example, a chamber may be formed directly in the projectile 1 itself for insertion of the microchip 32, and the stop device 10 may thus be a separate component.

The tracking signal may be any suitable signal (e.g., GPS, data, a combination of signals). The tracking signal may be emitted all of the time, or only some of the time (e.g., to increase battery life). For example, the tracking signal may be activated by the user by pulling an insulating tab to contact a battery with the microchip 32, e.g., just before firing the projectile. Or for example, the tracking signal may be activated by impact with a target. Still other ways of activating the tracking signal are contemplated, as will be readily appreciated by those having ordinary skill in the art after becoming familiar with the teachings herein.

Figure 7A:
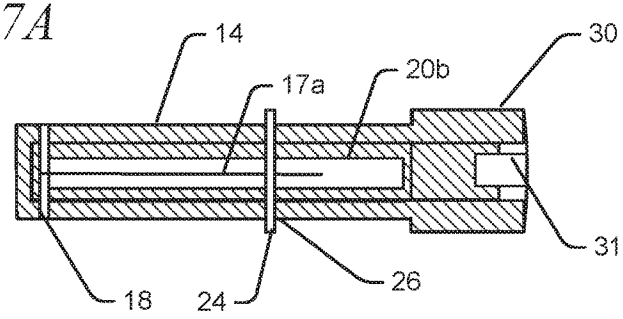
FIGS. 7A-7B are cross-sectional views of an inner shaft of the example projectile tracking with stop device, shown in FIG. 7A in a side view and in FIG. 7B in a top view.
Figure 7B:
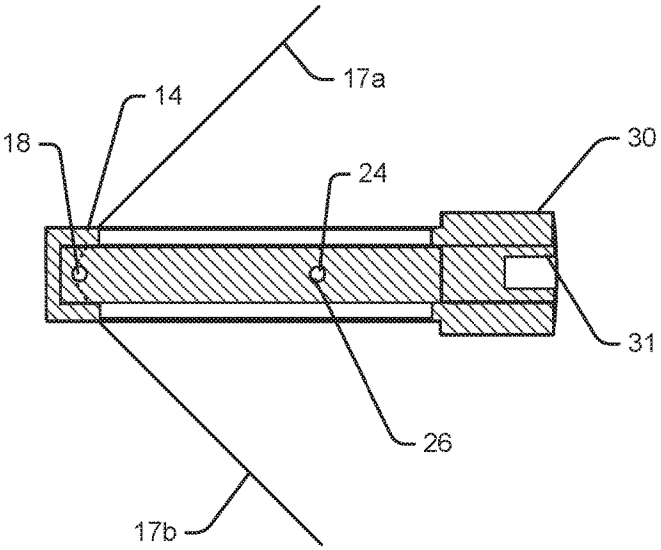
Figure 6A:
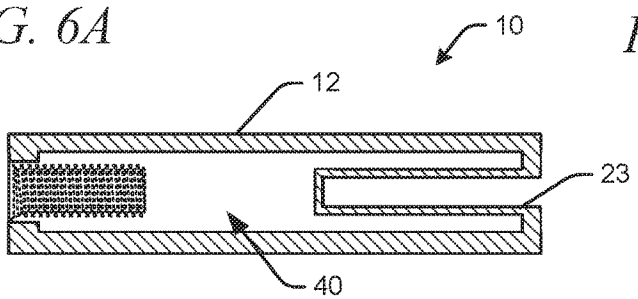
FIGS. 6A-6B are cross-sectional views of an outer sleeve of the example projectile tracking with stop device, shown in FIG. 6A in a side view and in FIG. 6B in a top view.
Figure 6B:
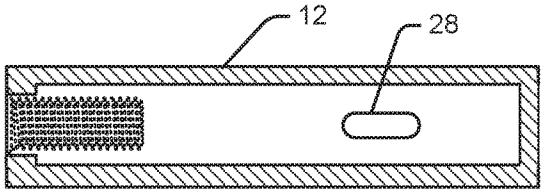

FIGS. 6A-6B are cross-sectional views of an outer sleeve 12 of the example projectile tracking with stop device 10, shown in FIG. 6A in a side view and in FIG. 6B in a top view. FIGS. 7A-7B are cross-sectional views of an inner shaft 14 of the example projectile tracking with stop device, shown in FIG. 7A in a side view and in FIG. 7B in a top view.

The outer sleeve 12 has an interior chamber 40 that is assembled over an exterior portion 42 of the inner shaft 14 when the outer sleeve 12 is slid onto the inner shaft 14 during assembly.

A stop-blade 16 having blades 17*a* and 17*b* are attached on a pin 18 in the inner shaft 14. The blades 17*a* and 17*b* fold into the inner shaft 14 when the outer sleeve 12 is in a closed position. The blades 17*a* and 17*b* expand out beyond an outer circumference of the outer sleeve 12 when the outer sleeve 12 moves to an open position.

In an example, the projectile tracking and stop device has an inner blade slot 20*b* formed on one side in the inner shaft 14 (and inner blade slot 20*a* formed on the opposite side of the inner shaft 14). An outer blade slot 23*b* is formed in the outer sleeve 12 (and outer blade slot 23*a* is formed on the opposite side of the outer shaft 12).

The blades 17*a* and 17*b* may formed from a single wire or strip (e.g., a strip of metal or plastic or other suitable blade material), that is wrapped around the post or pin 18 to form a spring or bias as the two blades 17*a* and 17*b* are pressed toward each other. As such, the blades 17*a* and 17*b* of the stop-blade 16 are biased in an outward position from the outer sleeve 12. When the blades 17*a* and 17*b* of the stop-blade 16 are folded into and maintained under tension in the inner shaft 14 during firing of the projectile. The blades 17*a* and 17*b* of the stop-blade 16 then automatically release (due to release of tension) into the outward position upon the projectile impacting an object.

As such, the two blades 17*a* and 17*b* of the stop-blade 16 expand out through the inner blade slots 20*a* and 20*b*, and the outer blade slots 23*a* and 23*b*, beyond the outer circumference of the outer sleeve 12 when the outer sleeve 12 moves on the inner shaft 14 (e.g., the distance of slot 28) to the open position.

Also shown in FIGS. 6B and 7B is the pin assembly. A pin 24 is assembled through an opening 26 formed through the inner shaft 14. A slot 28 is formed through the outer sleeve 12. The pin 24 limits sliding of the outer sleeve 14 between opposite ends of the slot 28 to designate a first position and a second position of travel for the outer sleeve 12. In an example, the first position corresponds to the open position of the outer sleeve 14, and the second position corresponds to the closed position of the outer sleeve 14.

Before continuing, it should be noted that the examples described above are provided for purposes of illustration, and are not intended to be limiting. Other devices and/or device configurations may be utilized to carry out the operations described herein.

Figure 8A:
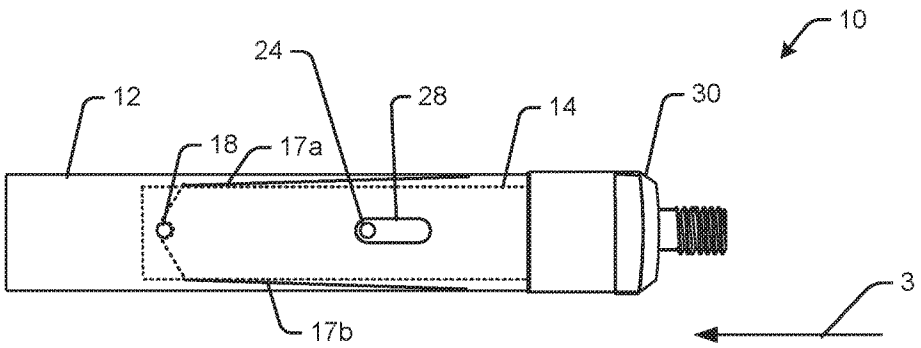
FIGS. 8A-8B are side views illustrating operation of an example projectile tracking with stop device, shown in FIG. 8A in a closed position and in FIG. 8B in an open position.
Figure 8B:
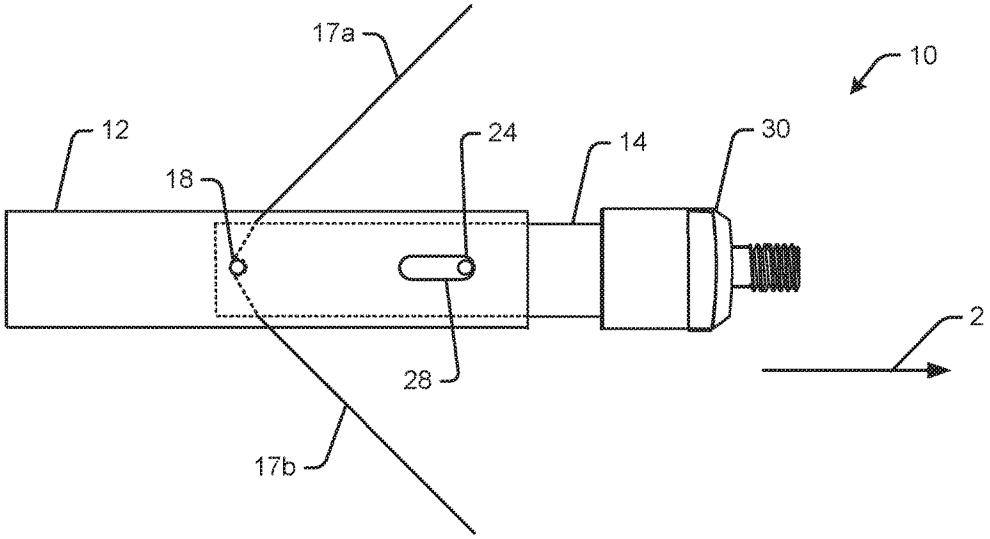
Figure 9A:
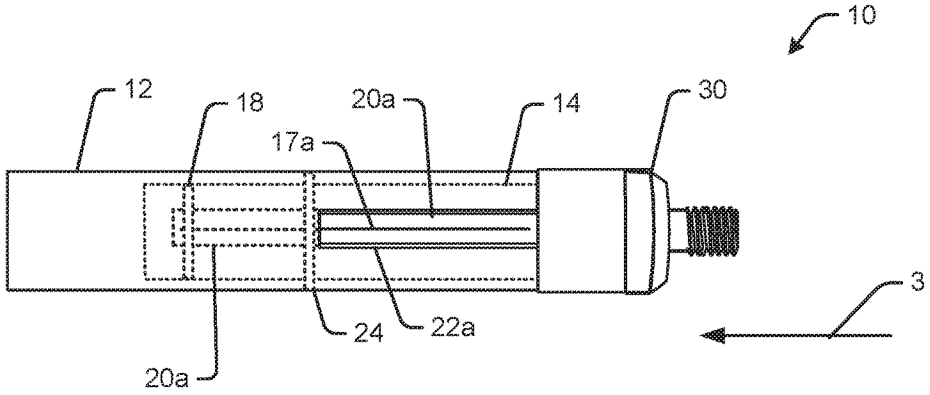
FIGS. 9A-9B are top views illustrating operation of an example projectile tracking with stop device, shown in FIG. 9A in a closed position and in FIG. 9B in an open position.
Figure 9B:
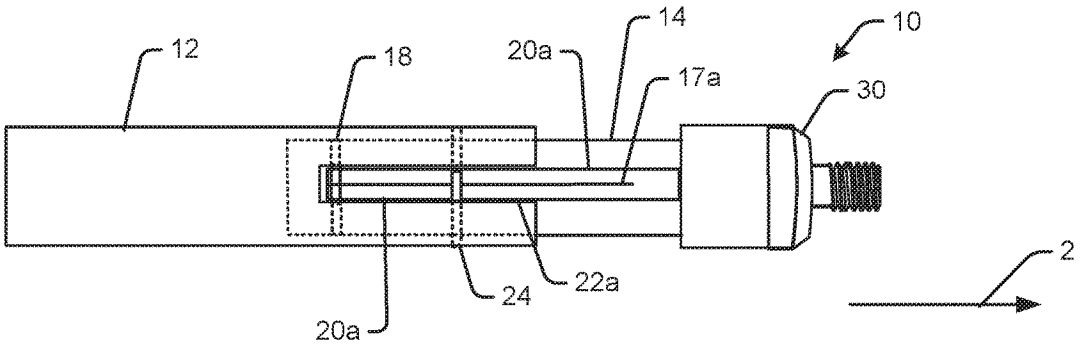

Operation of an example projectile tracking device 10 can be seen in FIGS. 8A-8B and FIGS. 9A-9B. FIGS. 8A-8B are side views illustrating operation of an example projectile tracking with stop device, shown in FIG. 8A in a closed position and in FIG. 8B in an open position. FIGS. 9A-9B are top views illustrating operation of an example projectile tracking with stop device, shown in FIG. 9A in a closed position and in FIG. 9B in an open position.

In an example, the projectile tracking device 10 is connected adjacent a blade portion of the arrow tip or other projectile. In an example, the projectile tracking device 10 includes a stopping mechanism, such as at least one stop-blade 16. The stop-blade is attached at a pivot inside the projectile tracking device 10 and pressed into the sleeve as illustrated by arrow 2 in FIG. 1A described above. In an example, the projectile tracking device 10 includes at least two blades 17*a* and 17*b*, although fewer or more stop-blades may be provided (e.g., for a larger projectile).

The stop-blade 16 is released from the sleeve when the outer sleeve 12 moves in the direction of arrow 3 in FIG. 1B. This causes the stop-blade 16 to expand upon impact (e.g., upon entry into a hunted animal). This retains the projectile tracking device 10 in an animal even if the animal continues to move. Retaining the arrow tip in the animal enables tracking both the projectile tracking device 10 and the animal as the animal may continue to move.

The microchip 32 or other transmitter is provided in the projectile tracking device 10. The microchip 32 emits a tracking signal for locating the projectile tracking device 10 after it has been fired. In an example, the microchip 32 transmits a GPS signal or other locating signal. The signal may be processed, e.g., using a smart phone executing an "app" or dedicated device executing program code to locate the projectile tracking device 10 based on the tracking signal emitted by the microchip 32. The microchip 32 can be activated by its own transmitter, smart phone, etc. The microchip 32 may have any suitable range, such as about 1 mile.

The stop-blade(s) are folded against a spring or other bias so that it is substantially parallel to a shaft of the projectile tracking device 10 and can be inserted into the outer sleeve 12 of against the bias. In an example, a spring action pushes the stop-blade 16 out of the housing so that the stop-blade(s) automatically deploy outward upon exiting the outer sleeve 12. The stop-blades may be angled upon full deployment such that the projectile tracking device 10 can be said to "expand" once in the animal and cannot be readily pulled or fall out of the animal.

It is noted that the projectile tracking device 10 may be implemented with a "blank." In an example, a "blank" or practice arrow tip may be utilized in target shooting. The blank may weigh about the same and be about the same length as a standard arrow tip.

The operations shown and described herein are provided to illustrate example implementations. It is noted that the operations are not limited to the ordering shown. Still other operations may also be implemented.

It is noted that the examples shown and described are provided for purposes of illustration and are not intended to be limiting. Still other examples are also contemplated.

The invention claimed is:

1. A projectile tracking with stop device, comprising:

an outer sleeve and an inner shaft, the outer sleeve having an interior chamber slidably assembled over an exterior portion of the inner shaft, the outer sleeve and the inner shaft assembled for connecting to a projectile; and at least one stop-blade attached on a pin in the inner shaft, the at least one stop-blade folding into the inner shaft when the outer sleeve is in a closed position, and the at least one stop-blade expanding out beyond an outer circumference of the outer sleeve when the outer sleeve moves to an open position;

wherein the outer sleeve is attached to an arrow shaft.

2. The projectile tracking with stop device of claim 1, further comprising:

an end chamber formed in the inner shaft; and a microchip positioned at least partly in the end chamber of the inner shaft, the microchip emitting a tracking signal for locating the projectile.

3. The projectile tracking with stop device of claim 1, wherein the outer sleeve and the inner shaft are generally cylindrical in shape.

4. The projectile tracking with stop device of claim 1, wherein the outer sleeve is attached to an arrow tip on the arrow shaft.

5. The projectile tracking with stop device of claim 1, wherein the inner shaft is attached to an arrow tail on the arrow shaft.

6. The projectile tracking with stop device of claim 1, wherein the at least one stop-blade has a blade biased in an outward position to automatically expand when the outer sleeve moves to the open position.

7. The projectile tracking with stop device of claim 1, wherein the at least one stop-blade has two blades, each of the two blades automatically expanding out beyond the outer circumference of the outer sleeve when the outer sleeve moves to the open position.

8. The projectile tracking with stop device of claim 1, further comprising at least an inner blade slot formed in the inner shaft, and at least an outer blade slot formed in the outer sleeve, wherein the at least one stop-blade expands out through the inner blade slot and the outer blade slot beyond the outer circumference of the outer sleeve when the outer sleeve moves to the open position.

9. The projectile tracking with stop device of claim 1, wherein the at least one stop-blade has a blade biased in an outward position, the blade of the stop-blade folded into and maintained under tension in the inner shaft during firing of the projectile, the stop-blade automatically releasing from the tension into the outward position upon the projectile impacting an object.

10. The projectile tracking with stop device of claim 1, further comprising a pin assembled through an opening formed through the inner shaft.

11. The projectile tracking with stop device of claim 10, further comprising a slot formed through the outer sleeve, wherein the pin limits travel distance of the outer sleeve between opposite ends of the slot to designate a first position and a second position of the outer sleeve, wherein the first position corresponds to the open position of the outer sleeve, and the second position corresponds to the closed position of the outer sleeve.

12. A projectile tracking with stop device, comprising:

an outer sleeve and an inner shaft, the outer sleeve having an interior chamber assembled over an exterior portion of the inner shaft, the outer sleeve and the inner shaft assembled together for connecting to a projectile; and a stop-blade attached on a pin in the inner shaft, the stop-blade having at least two blades formed from a single wire or strip wrapped on a post, the at least two blades folding under tension into the inner shaft when the outer sleeve is in a closed position, and the at least two blades automatically expanding from release of the tension out beyond an outer circumference of the outer sleeve when the outer sleeve moves to an open position.

13. The projectile tracking with stop device of claim 12, further comprising:

an end chamber formed in the inner shaft; and a microchip positioned at least partly in the end chamber of the inner shaft, the microchip emitting a tracking signal for locating the projectile.

14. The projectile tracking with stop device of claim 12, further comprising an inner blade slot formed in the inner shaft, and an outer blade slot formed in the outer sleeve; wherein the two blades of the stop-blade expand out through the inner blade slot and the outer blade slot beyond the outer circumference of the outer sleeve when the outer sleeve moves to the open position.

15. The projectile tracking with stop device of claim 12, wherein the two blades of the stop-blade are biased in an outward position; the two blades of the stop-blade are folded into the inner shaft and maintained in the inner shaft during firing of the projectile, the two blades of the stop-blade automatically releasing into the outward position upon the projectile impacting an object.

16. The projectile tracking with stop device of claim 12, further comprising:

a pin assembled through a pin-hole opening formed through the inner shaft; and a slot formed through the outer sleeve, wherein the outer sleeve slides along the pin in the slot between a first position and a second position in the slot formed through the outer sleeve, wherein the first position corresponds to the open position of the outer sleeve, and the second position corresponds to the closed position of the outer sleeve.

17. A projectile tracking with stop device, comprising:

an outer sleeve and an inner shaft, the outer sleeve having an interior chamber assembled over an exterior portion of the inner shaft, the outer sleeve and the inner shaft assembled for connecting to a projectile;

an end chamber formed in the inner shaft;

a microchip positioned at least partly in the end chamber of the inner shaft, the microchip emitting a tracking signal for locating the projectile; and a stop-blade attached on a pin in the inner shaft, the stop-blade having at least two blades, the at least two blades folding into the inner shaft when the outer sleeve is in a closed position, and the at least two blades expanding out beyond an outer circumference of the outer sleeve when the outer sleeve moves to an open position;

wherein the at least two blades of the stop-blade are under tension around a post for bias in an expanded position from the outer sleeve, the two blades of the stop-blade folded under the tension into and maintained in the inner shaft during firing of the projectile, so that the two blades of the stop-blade automatically release into the expanded position upon the projectile impacting an object.

18. The projectile tracking with stop device of claim 17, further comprising an inner blade slot formed in the inner shaft, and an outer blade slot formed in the outer sleeve, wherein the two blades of the stop-blade expand out through the inner blade slot and the outer blade slot beyond the outer circumference of the outer sleeve when the outer sleeve moves to the open position.

19. The projectile tracking with stop device of claim 17, further comprising:

a pin assembled through an opening formed through the inner shaft; and a slot formed through the outer sleeve, wherein the pin limits sliding distance of the outer sleeve between opposite ends of the slot to designate a first position and a second position of the outer sleeve, wherein the first position corresponds to the open position of the outer sleeve, and the second position corresponds to the closed position of the outer sleeve.

20. A projectile tracking with stop device, comprising:

an outer sleeve and an inner shaft, the outer sleeve having an interior chamber slidably assembled over an exterior portion of the inner shaft, the outer sleeve and the inner shaft assembled for connecting to a projectile;

at least one stop-blade attached on a pin in the inner shaft, the at least one stop-blade folding into the inner shaft when the outer sleeve is in a closed position, and the at least one stop-blade expanding out beyond an outer circumference of the outer sleeve when the outer sleeve moves to an open position; and at least an inner blade slot formed in the inner shaft, and at least an outer blade slot formed in the outer sleeve, wherein the at least one stop-blade expands out through the inner blade slot and the outer blade slot beyond the outer circumference of the outer sleeve when the outer sleeve moves to the open position.

21. A projectile tracking with stop device, comprising:

an outer sleeve and an inner shaft, the outer sleeve having an interior chamber slidably assembled over an exterior portion of the inner shaft; the outer sleeve and the inner shaft assembled for connecting to a projectile; and at least one stop-blade attached on a pin in the inner shaft, the at least one stop-blade folding into the inner shaft when the outer sleeve is in a closed position, and the at least one stop-blade expanding out beyond an outer circumference of the outer sleeve when the outer sleeve moves to an open position;

wherein the at least one stop-blade has a blade biased in an outward position, the blade of the stop-blade folded into and maintained under tension in the inner shaft during firing of the projectile, the stop-blade automatically releasing from the tension into the outward position upon the projectile impacting an object.

22. A projectile tracking with stop device, comprising:

an outer sleeve and an inner shaft, the outer sleeve having an interior chamber slidably assembled over an exterior portion of the inner shaft, the outer sleeve and the inner shaft assembled for connecting to a projectile;

at least one stop-blade attached on a pin in the inner shaft, the at least one stop-blade folding into the inner shaft when the outer sleeve is in a closed position, and the at least one stop-blade expanding out beyond an outer circumference of the outer sleeve when the outer sleeve moves to an open position;

a pin assembled through an opening formed through the inner shaft; and a slot formed through the outer sleeve, wherein the pin limits travel distance of the outer sleeve between opposite ends of the slot to designate a first position and a second position of the outer sleeve, wherein the first position corresponds to the open position of the outer sleeve, and the second position corresponds to the closed position of the outer sleeve.

* * * * *